US010947982B2

(12) United States Patent
Lee et al.

(10) Patent No.: US 10,947,982 B2
(45) Date of Patent: Mar. 16, 2021

(54) METHOD OF DETERMINING CIRCULATION STATE OF COOLING WATER

(71) Applicants: Hyundai Motor Company, Seoul (KR); Kia Motors Corporation, Seoul (KR)

(72) Inventors: Dong Hun Lee, Gyeonggi-do (KR); Kang Sik Jeon, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 494 days.

(21) Appl. No.: 15/836,349

(22) Filed: Dec. 8, 2017

(65) Prior Publication Data

US 2018/0106256 A1 Apr. 19, 2018

Related U.S. Application Data

(63) Continuation-in-part of application No. 14/481,081, filed on Sep. 9, 2014, now abandoned.

(30) Foreign Application Priority Data

Feb. 6, 2014 (KR) ..... 10-2014-0013723

(51) Int. Cl.
*F04D 13/06* (2006.01)
*F04D 15/02* (2006.01)
*F04D 15/00* (2006.01)

(52) U.S. Cl.
CPC ..... *F04D 15/0236* (2013.01); *F04D 15/0066* (2013.01); *F04D 15/0077* (2013.01);
(Continued)

(58) Field of Classification Search
CPC ..... F04D 15/0236; F04D 15/0066; F04D 15/0077; F04D 15/0088; F04D 15/0254; F04D 13/062; F04D 13/06
See application file for complete search history.

(56) References Cited

U.S. PATENT DOCUMENTS 5,969,496 A * 10/1999 Yamada ..... H02P 1/52 318/254.1
6,293,838 B1 9/2001 Ferguson
(Continued)

FOREIGN PATENT DOCUMENTS

DE 10 2013 004051 A1 9/2013
EP 2 574 524 A2 4/2013
(Continued)

OTHER PUBLICATIONS

Office Action for German Patent Application No. 10 2014 218 786.9, from German Patent Office dated Sep. 20, 2018, 6 pages.

*Primary Examiner* — Gregory J Toatley, Jr.
*Assistant Examiner* — Lynda Dinh
(74) *Attorney, Agent, or Firm* — Mintz Levin Cohn Ferris Glovsky and Popeo, P.C.; Peter F. Corless

(57) ABSTRACT

A method of determining a state of cooling water is provided. The method includes operating, by a controller, a driving motor of a cooling water-circulating pump that is configured to circulate cooling water at a fixed current, a fixed torque, or a fixed power. In addition, the controller is configured to calculate an average rotation speed of the driving motor for a preset first period of time during the operation of the driving motor. Whether the circulation state of the cooling water is normal is determined based on an error between the calculated average rotation speed and a preset reference rotation speed.

23 Claims, 10 Drawing Sheets

(52) U.S. Cl.
CPC ..... *F04D 15/0088* (2013.01); *F04D 15/0254* (2013.01); *F04D 13/06* (2013.01); *F04D 13/062* (2013.01)

(56) References Cited

U.S. PATENT DOCUMENTS

| | | | | |
|---|---|---|---|---|
| 2004/0186641 | A1* | 9/2004 | Hironaka | B62D 5/046 701/42 |
| 2009/0289583 | A1* | 11/2009 | Yoshida | B60L 15/025 318/400.01 |
| 2010/0198441 | A1 | 8/2010 | Mizuno et al. | |
| 2013/0125636 | A1* | 5/2013 | Cwik | F02N 11/0855 73/115.05 |
| 2013/0304309 | A1* | 11/2013 | Kakita | B60W 50/0205 701/31.7 |
| 2014/0093393 | A1* | 4/2014 | Araki | F01P 5/12 417/12 |
| 2015/0267708 | A1 | 9/2015 | Masuda et al. | |

FOREIGN PATENT DOCUMENTS

| | | | |
|---|---|---|---|
| JP | S59-162395 | A | 9/1984 |
| JP | H08-075617 | A | 3/1996 |
| JP | 2003-269174 | A | 9/2003 |
| JP | 2009-299665 | A | 12/2009 |
| JP | 2011-220676 | A | 11/2011 |
| JP | 2013-46531 | A | 3/2013 |
| JP | 2013-185497 | A | 9/2013 |
| KR | 10-2011-0062409 | A | 6/2011 |
| KR | 10-2011-0107975 | | 10/2011 |
| KR | 10-2013-0124789 | | 11/2013 |
| KR | 10-1361408 | B1 | 2/2014 |
| KR | 10-1406504 | B1 | 6/2014 |
| WO | 2009-006927 | A1 | 1/2009 |
| WO | 2012/164745 | A1 | 12/2012 |

* cited by examiner

REPLACEMENT SHEET
FIG. 2
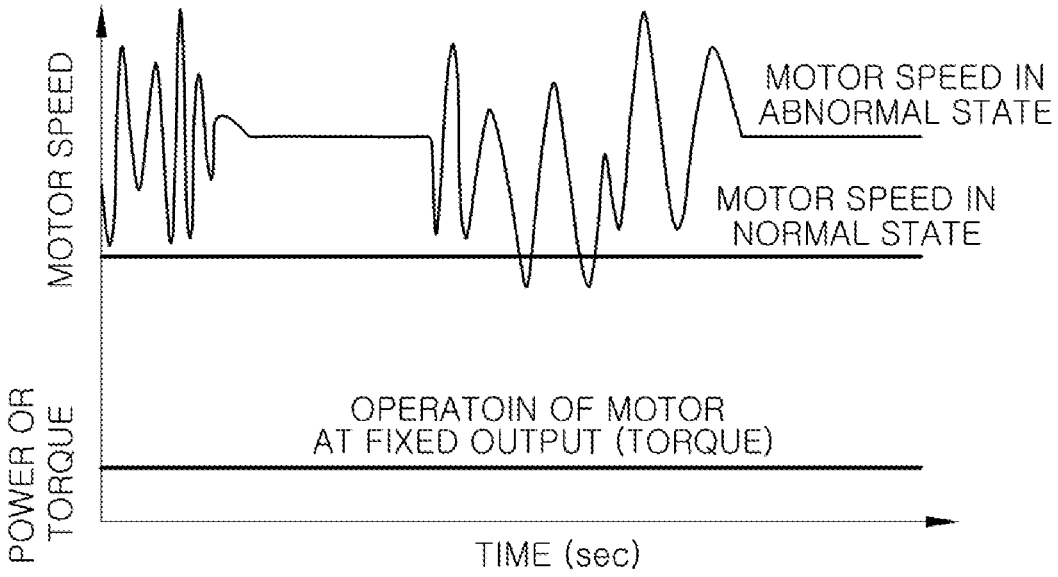

METHOD OF DETERMINING CIRCULATION STATE OF COOLING WATER

CROSS-REFERENCE(S) TO RELATED APPLICATION

The present application is a divisional application of U.S. patent application Ser. No. 14/481,081 filed Sep. 9, 2014, which claims priority of Korean Patent Application Number 10-2014-0013723 filed on Feb. 6, 2014, the entire contents of which application are incorporated herein for all purposes by this reference.

BACKGROUND

Field of the Invention

The present invention relates to a method of determining a circulation state of cooling water, and more particularly to a method of determining a circulation state of cooling water from torque, power, and rotation speed of a cooling water-circulating pump.

Description of the Related Art

A fuel cell system mounted within a fuel cell vehicle includes a hydrogen supply mechanism that supplies hydrogen to a fuel cell stack, an air supply mechanism that supplies air containing oxygen serving as an oxidant necessary for electrochemical reaction, to the fuel cell stack, the fuel cell stack that produces electricity through the electrochemical reaction between the supplied hydrogen and oxygen, and a heat-and-water managing mechanism that eliminates heat generated by the electrochemical reaction and manages the operation temperature of the fuel cell stack.

The heat-and-water managing mechanism includes a pump configured to circulate cooling water through the fuel cell stack, a radiator configured to cool the cooling water discharged from the fuel cell stack, and an ion filter configured to filter out ions eluted from a cooling pipeline. The heat-and-water managing mechanism is equipped with an atmospheric pressure cap at an upper end thereof, an open-type reservoir, and a level sensor within the reservoir. The reservoir should have a substantially small packaging space in which the level sensor is installed. However, it may be difficult to secure the packaging space. Furthermore, although the packaging space is secured and the level sensor is installed within the packaging space, the level sensor may not be able to sense exhaustion of cooling water, indicating a normal level for the cooling water although an insufficient amount of cooling water is present when air is mixed with water in the cooling water.

In a conventional technology, a shortage of cooling water is detected by a level sensor installed within a reservoir or a pressure sensor installed within a pipeline. However, this conventional technology has the disadvantage that the level sensor or pressure sensor may malfunction due to disturbance such as a change in temperature of cooling water, a change in cooling loop attributable to opening and closing of a cooling pipeline valve, and vibration of a vehicle or equipment. In order to solve this problem, a flow sensor has been installed in a cooling water pipeline. However, in this solution also the flow sensor is expensive and is difficult to install due to the additional necessary piping for the installation of the flow sensor.

The foregoing is intended merely to aid in the understanding of the background of the present invention, and is not intended to mean that the present invention falls within the purview of the related art that is already known to those skilled in the art.

SUMMARY

Accordingly, the present invention provides a method of determining a circulation state of cooling water, which may detect shortage and abnormal circulation of cooling water.

According to one aspect, a method of determining a circulation state of cooling water may include: operating a driving motor configured to drive a cooling water-circulating pump at a fixed current, fixed torque, or fixed power; calculating an average rotation speed of the driving motor for a first period of time preset during the operation of the driving motor; and determining whether the circulation state of the cooling water is normal (e.g., without error or with minimal error), from a calculated error between the average rotation speed of the driving motor and a preset reference rotation speed of the driving motor.

The calculation of the average rotation speed may include calculating a deviation in a rotation speed of the driving motor for the first period of time. The determination of the circulation state of the cooling water may refer to a step of determining whether the circulation step of the cooling water is normal by comparing the calculated deviation in the rotation speed a preset reference deviation. The reference rotation speed may be a rotation speed of the driving motor which corresponds to the fixed current, fixed torque, or fixed power.

According to another aspect, a method of determining a circulation state of cooling water may include: operating a driving motor disposed a pump for circulating a cooling water-circulating to maintain a rotation speed of the driving motor for the cooling water-circulating pump to be substantially constant; and determining whether the circulation state of the cooling water is normal using a power or torque value of the driving motor after the rotation speed of the driving motor is maintained substantially constant, and a reference power or torque value during a normal state which corresponds to the rotation speed of the driving motor maintained substantially constant.

The power or torque value of the driving motor, and the power or torque value at the rotation speed may be each obtained using a current command value transmitted to the driving motor and a normal current command value during a normal state which corresponds to the rotation speed which may be maintained substantially constant. The determination of the circulation state of the cooling water may include calculating an average value of the current command values transmitted to the driving motor for the first period of time after the rotation speed is maintained substantially constant, and determining whether the circulation state of the cooling water is normal, based on an error value between the calculated average value and the current command value during the normal state which corresponds to the substantially constant rotation speed.

The method may further include a normalizing step of dividing the calculated average value by the current command value during the normal state which corresponds to the substantially constant rotation speed. When a state where the error value exceeds a preset error value is maintained for a second period of time, the circulation state of the cooling water may be determined to be abnormal. When the error value exceeds the preset error value, the method may further include enabling a test mode. When a state where an error value between the calculated average value and a current command value used when the driving motor rotates at a maximum rotation speed exceeds the preset error value is maintained for the second period of time in the test mode, the circulation state of the cooling may be determined to be abnormal. The preset error value may vary according to the rotation speed of the driving motor. The current command value that corresponds to the rotation speed may be obtained using a current command map preset according to rotation speeds. When the test mode is enabled, the driving motor may be controlled to maintain the maximum rotation speed.

The determination of the circulation state of the cooling water may include calculating a deviation or a variation value in current command value for the first period of time, and determining whether the circulation state of the cooling water is normal, based on a result of a comparison between the calculated deviation or variation value and a preset reference variation value. When a state where the deviation or variation value which is calculated exceeds the preset reference variation value is maintained for the second period of time, the circulation state of the cooling water may be determined to be abnormal. When the deviation or variation value which is calculated exceeds the preset reference variation value, the method may include enabling a test mode. When the test mode is enabled, the driving motor may be controlled to maintain a maximum rotation speed.

The determination of the circulation state of the cooling water may include integrating an error value between a current command value that corresponds to the rotation speed and a current command value transmitted to the driving motor, and determining whether a circulation state of the cooling water is normal, based on a result of the comparison between a value of the integral operation and a preset error value.

The method may further include a normalization step of dividing the calculated average value by the current command value during the normal state which corresponds to the rotation speed. When a state where the value of the integral operation exceeds the preset error value for the second period of time, the circulation state of the cooling water may be determined to be abnormal. When the value of the integral operation exceeds the preset error value, the method may further include enabling a test mode. When the test mode is enabled, the driving motor may be controlled to cause the driving motor to rotate at a maximum rotation speed.

According to a further aspect, a method of determining a circulation state of cooling water may include: operating a driving motor of a pump configured to circulate cooling water to maintain a rotation speed of the driving motor substantially constant; and enabling a test mode when an error value between a power or torque value of the driving motor for a preset period of time after the rotation speed becomes constant and a reference power or torque value during a normal state which corresponds to the substantially constant rotation speed is occurred. In the test mode, whether the circulation state of the cooling water is normal (e.g., without error or with minimal error) may be determined, in a state where the maximum rotation speed of the driving motor may be maintained.

BRIEF DESCRIPTION OF THE DRAWINGS

The above and other objects, features and other advantages of the present invention will be more clearly understood from the following detailed description when taken in conjunction with the accompanying drawings, in which:

FIG. 2 is an exemplary graph showing rotation speeds of a driving motor in a normal circulation state and in an abnormal circulation state of cooling water when the driving motor is operated at a fixed current in a method of determining a circulation state of cooling water according to one exemplary embodiment of the present invention;

DETAILED DESCRIPTION

Figure 1A:
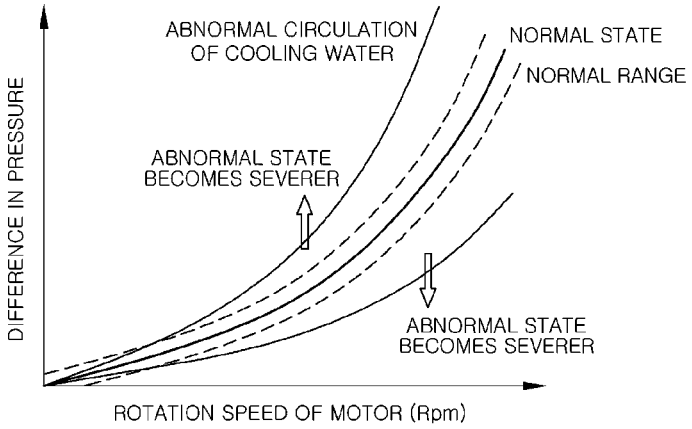
FIG. 1A is an exemplary graph showing relations between a rotation speed of a driving motor and a difference in pressure between an inlet and an outlet of a cooling water-circulating pump according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Specific structural and functional descriptions of exemplary embodiments of the present invention disclosed herein are only for illustrative purposes of the exemplary embodiments of the present invention. The present invention may be embodied in many different forms without departing from the spirit and significant characteristics of the present invention. Therefore, the exemplary embodiments of the present invention are disclosed only for illustrative purposes and should not be construed as limiting the present invention.

Reference will now be made in detail to various exemplary embodiments of the present invention, specific examples of which are illustrated in the accompanying drawings and described below, since the exemplary embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

It will be understood that, although the terms "first," "second," etc. may be used herein to describe various elements, these elements should not be limited by these terms. These terms are only used to distinguish one element from another element. For instance, a first element discussed below could be termed a second element without departing from the teachings of the present invention. Similarly, the second element could also be termed the first element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between," "directly between," "adjacent to," or "directly adjacent to," should be construed in the same way.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinbelow, exemplary embodiments of the present invention will be described in detail with reference to the accompanying drawings. Throughout the drawings, the same reference numerals will refer to the same or like parts.

Figure 1B:
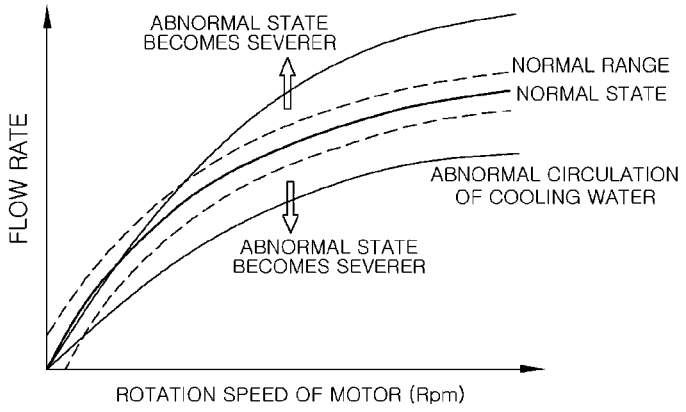
FIG. 1B is an exemplary graph showing relations between a rotation speed of a driving motor and a flow rate of cooling water according to an exemplary embodiment of the present invention.
Figure 1C:
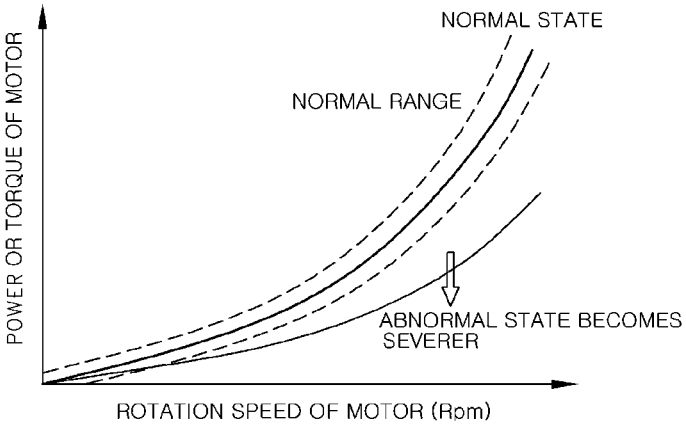
FIG. 1C is an exemplary graph showing relations between a rotation speed of a driving motor and a power or torque of a driving motor according to an exemplary embodiment of the present invention.

FIG. 1A is an exemplary graph showing relations between a rotation speed of a driving motor and a difference in pressure between an inlet and an outlet of a cooling water-circulating pump, FIG. 1B is an exemplary graph showing relations between a rotation speed of a driving motor and a flow rate of cooling water, and FIG. 1C is an exemplary graph showing relations between a rotation speed of a driving motor and a power or torque of a driving motor.

With reference to FIGS. 1A to 1C, when cooling water circulates normally in a cooling system, that is, without a shortage, the difference in pressure between the inlet and the outlet of the cooling water-circulating pump and the flow rate of the cooling water are within normal ranges (e.g., predetermined ranges). In particular, the torque required to drive the cooling water circulating pump at a substantially constant speed may also be within a predetermined range indicating a normal state. However, when the cooling water does not circulate normally, the flow rate of the cooling water and the difference in pressure may be beyond the normal ranges, and the torque or power of the driving motor may be beyond (e.g., out of) the predetermined range. In particular, the operation speed of the cooling water-circulating pump may not be maintained at the target value and may fluctuate based on the load of the cooling water-circulating pump.

FIG. 2 is an exemplary graph showing rotation speeds of a driving motor in a normal circulation state and in an abnormal circulation state of cooling water when the driving motor is operated at a fixed current in a method of determining a circulation state of cooling water according to one exemplary embodiment of the present invention. With reference to FIG. 2, when the driving motor is operated at a fixed current and when the power or torque of the driving motor is constant with time, the rotation speed of the driving motor may be substantially constant when the circulation state of the cooling is normal. The rotation speed of the driving motor may fluctuate when the circulation state of the cooling is abnormal, i.e. the shortage of cooling water occurs or the load changes due to clogging of a pipeline, for example, occurs.

More specifically, when the power or torque of the driving motor is substantially constant and when the circulation state of cooling water is abnormal an in sufficient amount of the cooling water may be available since the load of the cooling water-circulating pump (or driving motor) may decrease due to bubbles (e.g., air bubbles) in cooling water pipelines, an average rotation speed of the driving motor may increase, compared to a normal circulation state. In particular, when bubbles are introduced into the cooling water circulating-pump, the rotation speed of the driving motor may fluctuate significantly due to a sudden change in the load. When the amount of cooling water is insufficient due to a leakage of the cooling water, bubbles may be continuously introduced into the cooling water-circulating pump, causing continuous fluctuations in the rotation speed of the driving motor, or water may not be discharged properly, increasing the rotation speed of the driving motor, compared to the normal circulation state.

When foreign matters or impurities circulate along with the cooling water through the cooling water pipeline, the load of the cooling water-circulating pump may change or the rotation speed of the driving motor may fluctuate, similar to when bubbles are introduced into the cooling water circulating pump. Furthermore, when the cooling water pipeline is clogged by foreign matters or physically deformed portions of the cooling water pipeline, the load of the cooling water-circulating pump may decrease significantly and the rotation speed of the driving motor may be increased significantly, compared to the normal circulation state.

Figure 3:
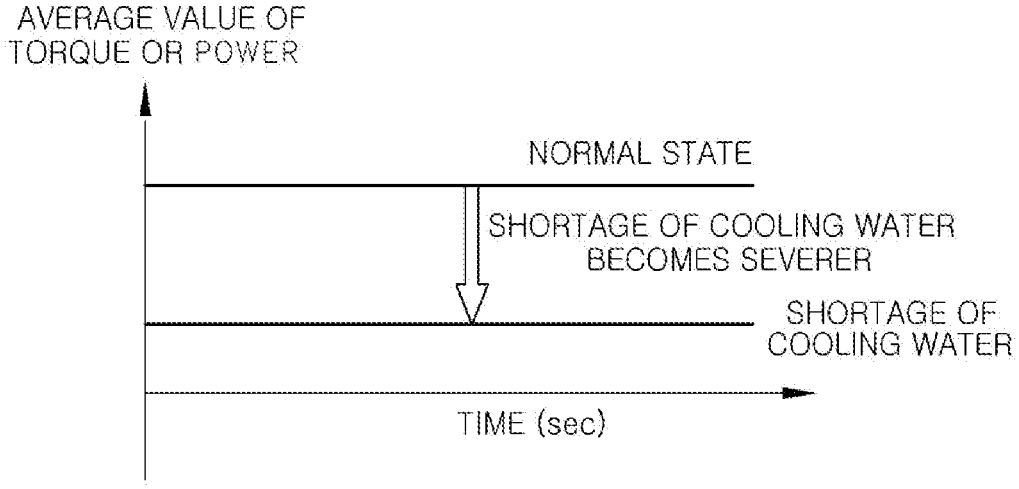
FIG. 3 is an exemplary graph showing an average value of powers or torques of a driving motor for each circulation state of cooling water in a method of determining a circulation state of cooling water according to one exemplary embodiment of the present invention.

FIG. 3 is an exemplary graph showing an average value of the power or torque of a driving motor for each circulation state of cooling water in the method of determining the circulation state of cooling water according to one exemplary embodiment of the present invention. FIG. 3 shows a comparison between data of the power or torque of a driving motor when the amount of cooling water is normal (e.g., no insufficient) and data of the power or torque of a driving motor when the amount of cooling water is abnormal (e.g., insufficient). When the amount of cooling water is insufficient, the power or torque of a driving motor may be caused to fluctuate. FIG. 3 shows average values of the fluctuating powers and torques. When the amount of cooling water is insufficient, the average value of the powers of a driving motor decreases and a deviation from the average value increases.

There are various methods of obtaining the power or torque of a driving motor. The methods include a method of measuring a single-phase (DC) current and voltage, a method of measuring a three-phase current and voltage, a method of using a torque sensor, and a method of using a preset torque map according to a rotation speed and an input voltage after measuring a three-phase current. A current command is proportional to the torque of a driving motor. Accordingly, it may be possible to calculate the torque based on a value of the three-phase current (e.g., a vector sum of three phases of currents) confirmed using the current command or measured by a current sensor.

Figure 4:
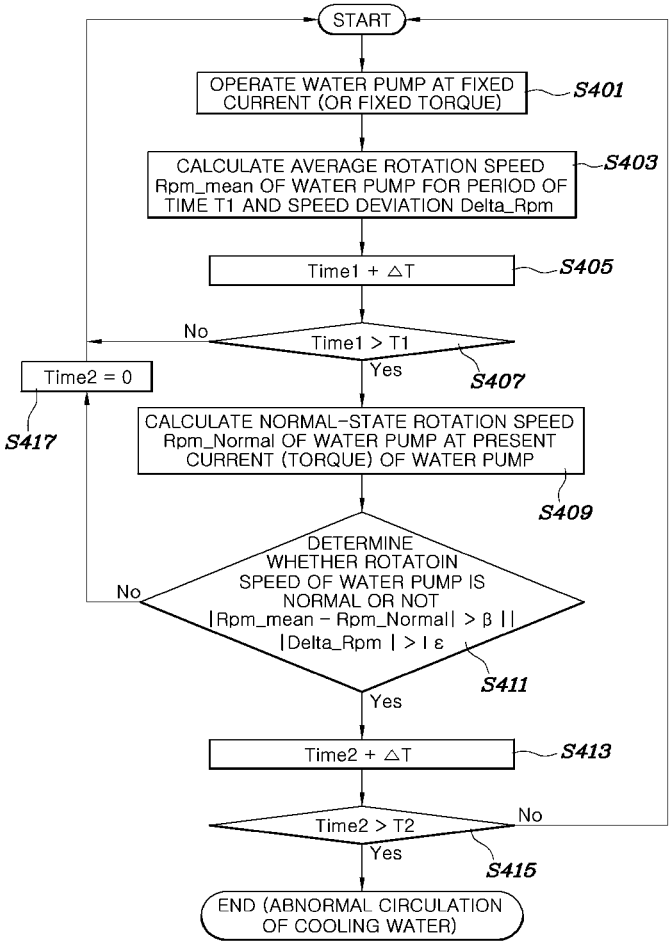
FIG. 4 is an exemplary flowchart showing a method of determining a circulation state of cooling water according to one exemplary embodiment of the present invention.

FIG. 4 is an exemplary flowchart showing a method of determining a circulation state of cooling water according to one exemplary embodiment of the present invention. First, a cooling water-circulating pump, i.e., a cooling water driving motor may be operated by a controller at a substantially fixed current (Step S401). While the cooling water driving motor is operated at the fixed current, an average rotation speed Rpm_mean or an average rotation deviation Delta_Rpm for a first period of time T1, which may be preset, may be calculated by the controller (Step S403). After a predetermined period of time Time_1+ΔT passes (Step S405), the controller may be configured to determine whether a predetermined elapsed time Time_1 greater than the first period of time T1 has elapsed (Step S407). The purpose of this step is to determine a circulation state of cooling water after the average rotation speed Rpm_mean and the average rotation speed deviation Delta_Rpm for the first period of time T1 may be calculated.

In response to determining that the first period of time T1 has elapsed; the controller may be configured to determine whether the rotation speed of a driving motor is normal (e.g., within a predetermined range), compared to a preset reference rotation (Step S411). The reference rotation speed may be set in advance to a rotation speed of a driving motor detected when the driving motor operates at the substantially fixed current, or calculated from a normal-state rotation speed Rpm_Normal of the cooling water-circulating pump when the driving motor operates at the substantially fixed current (Step S409). The controller may further be configured to determine whether the rotation speed of the driving motor is normal or abnormal, based on an error value between the calculated average rotation speed Rpm_mean and the calculated normal-state rotation speed Rpm_Normal at the fixed current, or an error value between the rotation speed deviation Delta_Rpm for the first period of time T1 and a preset reference deviation ε. In particular, when determining whether the circulation state of the cooling water is normal, when the error value between the calculated average rotation speed Rpm_mean and the normal-state rotation speed Rpm_Normal at the fixed current is greater than a preset error value β, or when the rotation speed deviation Delta_Rpm for the first period of time T1 is greater than the reference deviation c is maintained for a second period of time T2 which may be preset (Step S413 and Step S415), the controller may be configured to determine that the circulation state of the cooling water is abnormal.

When the first period of time T1 or the second period of time T2 which may be preset has not elapsed, when the error value between the calculated average rotation speed Rpm_mean and the normal state rotation speed Rpm_Normal at the fixed current is less than the preset error value β, or when the rotation speed deviation Delta_Rpm for the first period of time T1 is less than the reference deviation ε, the process may restart with Step 401. Subsequently, Step S401 in which the driving motor is operated at the fixed current may be repeatedly performed. To calculate the rotation speed deviation Delta_Rpm for the first period of time T1, an average value of absolute errors, a standard deviation, or a dispersion in the rotation speed for a preset period of time may be used. Furthermore, either one or both of the average rotation speed and the rotation speed deviation may be used to determine whether the circulation speed of the cooling water is normal.

Figure 5:
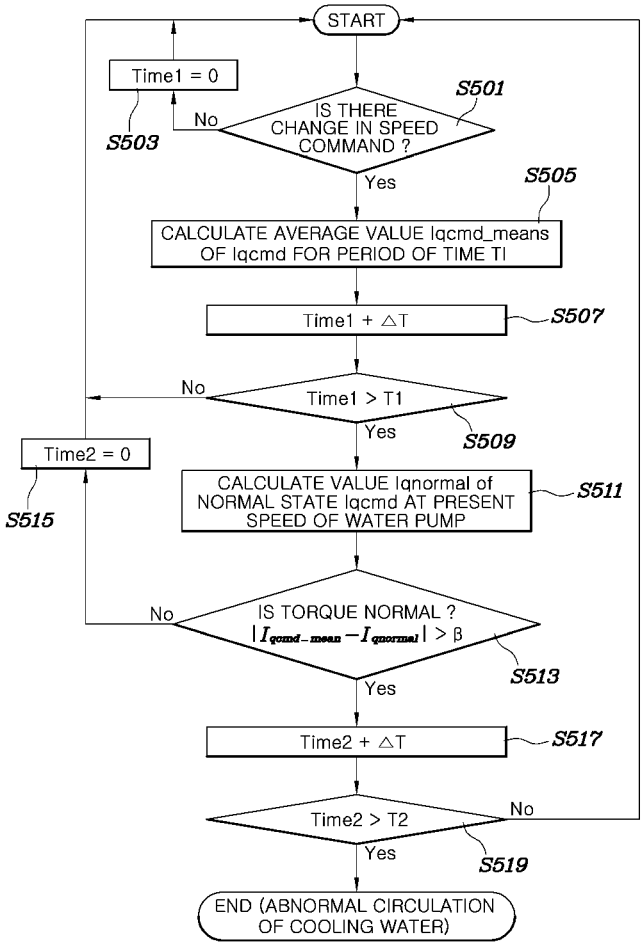
FIGS. 5 through 10 are exemplary flowcharts showing methods of determining a circulation state of cooling water according to other exemplary embodiments of the present invention.
Figure 6:
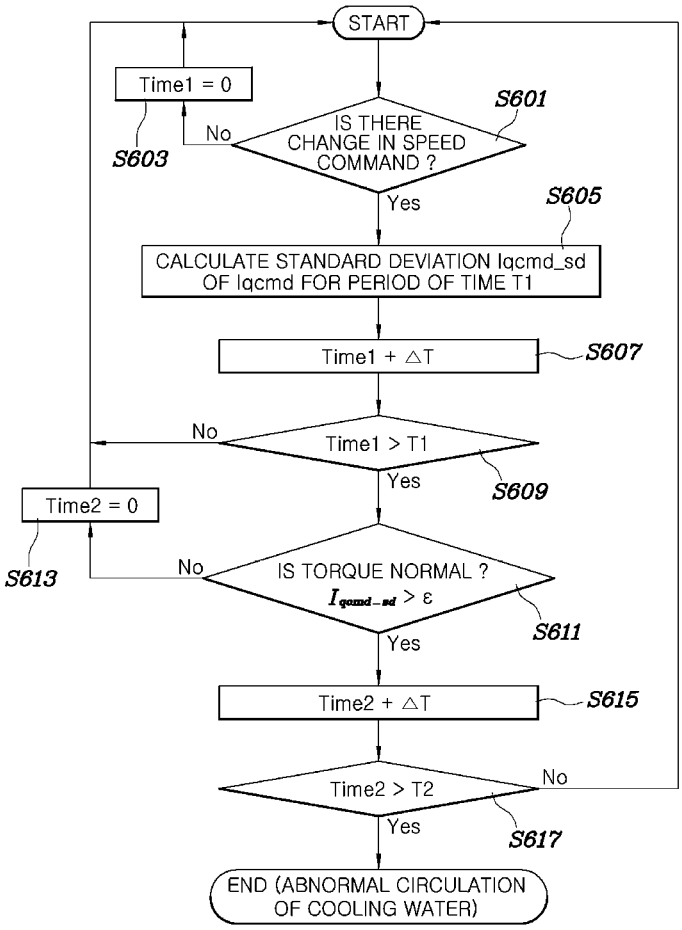
Figure 7:
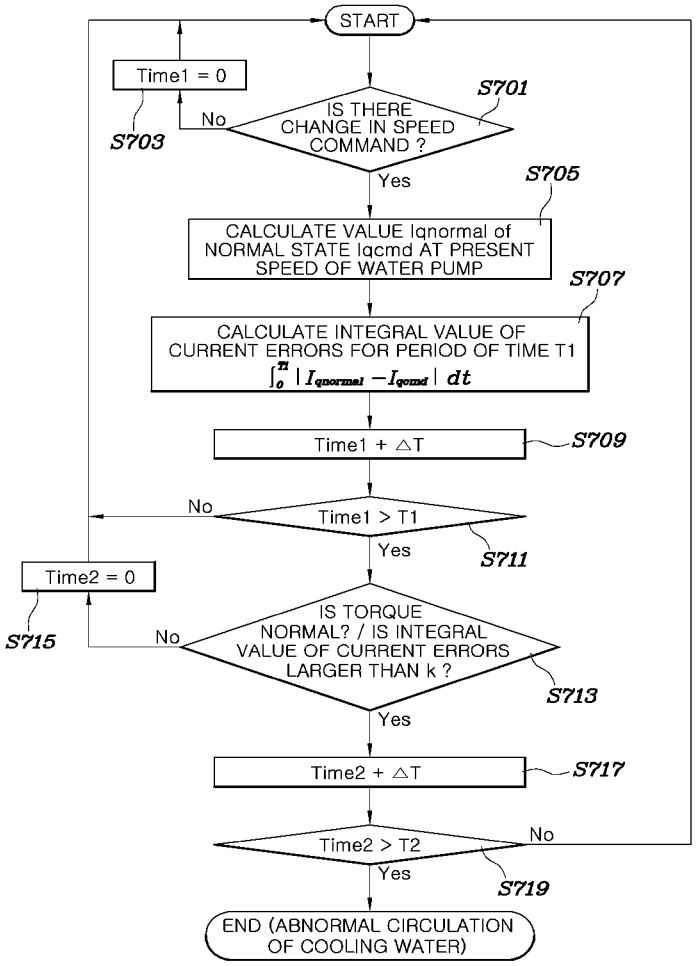

FIGS. 5 to 8 are exemplary flowcharts showing methods of determining a circulation state of cooling water according to other exemplary embodiments of the present invention. With reference to FIGS. 5 to 7, the controller may be configured to determine whether there is a change in speed command (Step S501, S601, and S701). The speed command may be a control command value regarding the rotation speed of a driving motor. These steps may be performed since a current command value may be changed to increase or decrease the rotation speed of a driving motor when the speed command is changed. To improve the accuracy of the current command value, the process determining a circulation state of cooling water may be performed after the rotation speed is maintained to be substantially constant.

After the rotation speed is maintained to be substantially constant, the controller may be configured to determine whether the circulation state of the cooling water is normal, from the current command value transmitted to the cooling water driving motor for a preset period of time and the normal current command value that corresponds to the rotation speed maintained for a preset period of time. Particularly, with reference to FIG. 5, after the constant rotation speed of a driving motor is maintained, an average value Iqcmd_mean of the current command values transmitted to the driving motor for a first period of time T1 may be calculated in Step S505. Next, the controller may be configured to determine whether the average value Iqcmd_mean of the current command values for the first period of time T1 is calculated normally, after a predetermined period of time ΔT has elapsed since a first elapsed time Time_1 passed, by comparing the first elapsed time Time_1 and the first period of time T1 (Step S507 and S509). When the first period of time T1 is less than the first elapsed time Time_1, the driving motor may be operated to adjust the rotation speed of the driving motor to be substantially constant (Step S501).

When the driving motor is not maintained at the constant rotation speed, the first elapsed time Time_1 may be reset (Step S503), and then the driving motor may be operated to adjust the rotation speed to be substantially constant (Step S501). After the rotation speed of the driving motor is adjusted to be substantially constant, the current command value Iqnormal that corresponds to the constant rotation speed may be calculated (Step S511). The current command value Iqnormal that corresponds to the constant rotation speed may be obtained using a current command map based on the rotation speed. The current command value Iqnormal that corresponds to the constant rotation speed may be a current command value in a normal state at a present rotation speed of a cooling water-circulating pump. The current command map may be a map in which normal current command values are mapped with rotation speeds of data obtained from experiments when a cooling water-circulating pump operates normally or rotation speeds of data obtained through calculations.

When an error between the calculated average value and a normal current command value that corresponds to a rotation speed is equal to or greater than a preset error value β (Step S515) and is maintained for a second period of time T2 (Step S517 and Step S519), that controller may be configured to determine that the circulation state of the cooling water is abnormal. Additionally, when the error value between the calculated average value and the normal current command value that corresponds to the rotation speed is less than the preset error value β, the second period of time T2 may be reset and the cooling water driving motor may be rotated at a new substantially constant rotation speed. When a normalized current command value Iqcmd_Nom obtained by dividing the current command value Iqcmd by the normal current command value Iqnormal at the present rotation speed and normalizing the result of the division is used, the speed command value may be continuously changed. Accordingly, it may be possible to determine whether the circulation state of the cooling water is normal even within a period of time during which the rotation speed changes.

With reference to FIG. 6, a deviation Iqcmd_sd or a variation value in the current command value Iqcmd for the first period of time T1 after the rotation speed of the driving motor is adjusted to be substantially constant may be calculated (Step S605). Further, the controller may be configured to determine whether the deviation Iqcmd_sd or the variation value for the first period of time T1 is accurately obtained (Step S607 and Step S609), and the calculated deviation Iqcmd_sd or variation value may be compared with a preset error value ε (Step S611). When the deviation Iqcmd_sd or variation value calculated exceeds the preset error value ε, and when such a state is maintained for a second period of time T2 (Step S615 and Step S617), the controller may be configured to determine that the circulation state of the cooling water is abnormal. A description regarding the same process as in FIG. 5 will not be repeated. The processing of FIG. 6 differs from the processing of FIG. 5 in that a standard deviation may be calculated instead of the average value.

With reference to FIG. 7, after the rotation speed of the driving motor is adjusted to be substantially constant and the substantially constant rotation speed may be maintained, a normal state current command value Iqnormal at the maintained constant rotation speed may be calculated (Step S705). Absolute values of errors between the current command values Iqcmd transmitted to the cooling water driving motor for the first period of time T1 and the normal state current command value Iqnormal may be integrated (Step S707). Further, the controller may be configured to determine whether the value of the integral operation for the first period of time T1 is accurate (Step S709 and Step S711). The value of the integral operation of the absolute values for the first period of time T1, and a preset error value k may be compared (Step S713). When a state where the value of the integral operation exceeds the preset error value k is continuously maintained for the second period of time T2 (Step S717 and Step S719), the controller may be configured to determine that the circulation state of the cooling water is abnormal.

When the normalized current command value Iqcmd_Nom obtained by dividing the current command value Iqcmd by the normal current command value at the rotation speed measured at a present time and by normalizing the result of the division is used, the speed command value may be continuously changed. Accordingly, it may be possible to determine whether the circulation state of the cooling water is normal even within a period of time during which the rotation speed changes.

Figure 8:
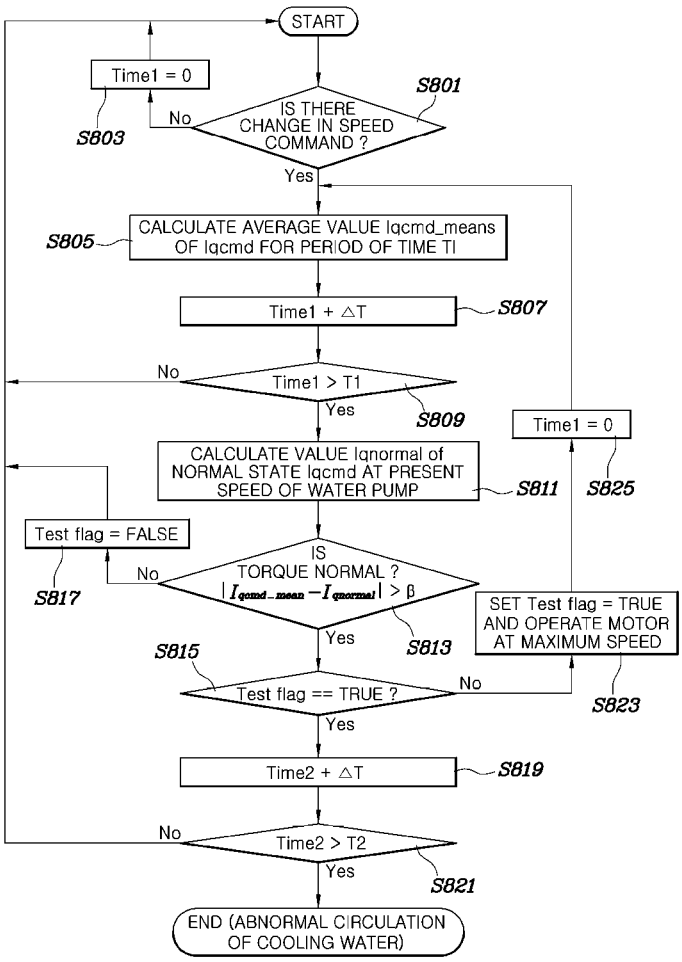
Figure 9:
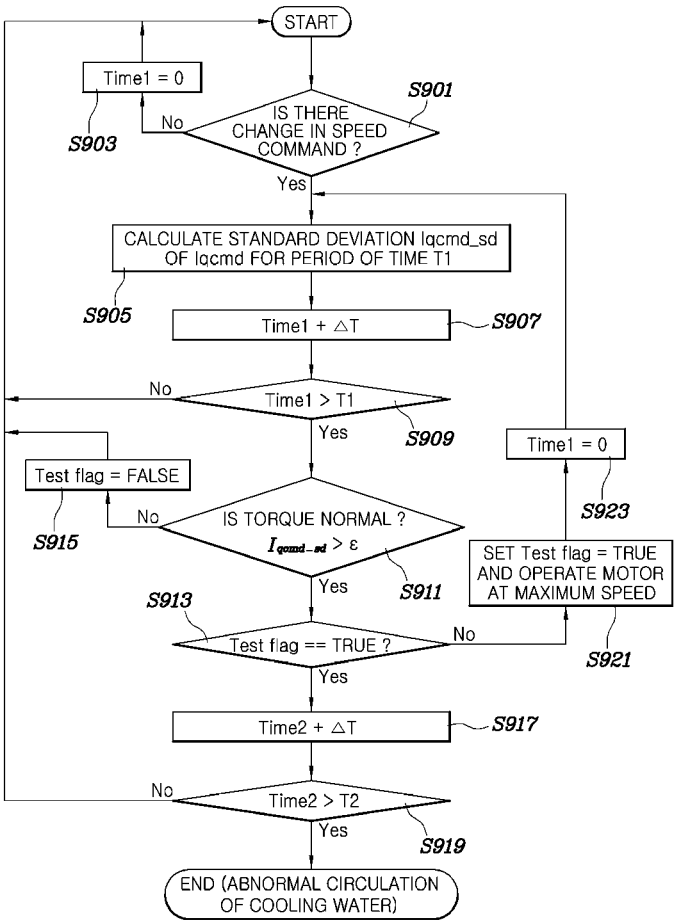
Figure 10:
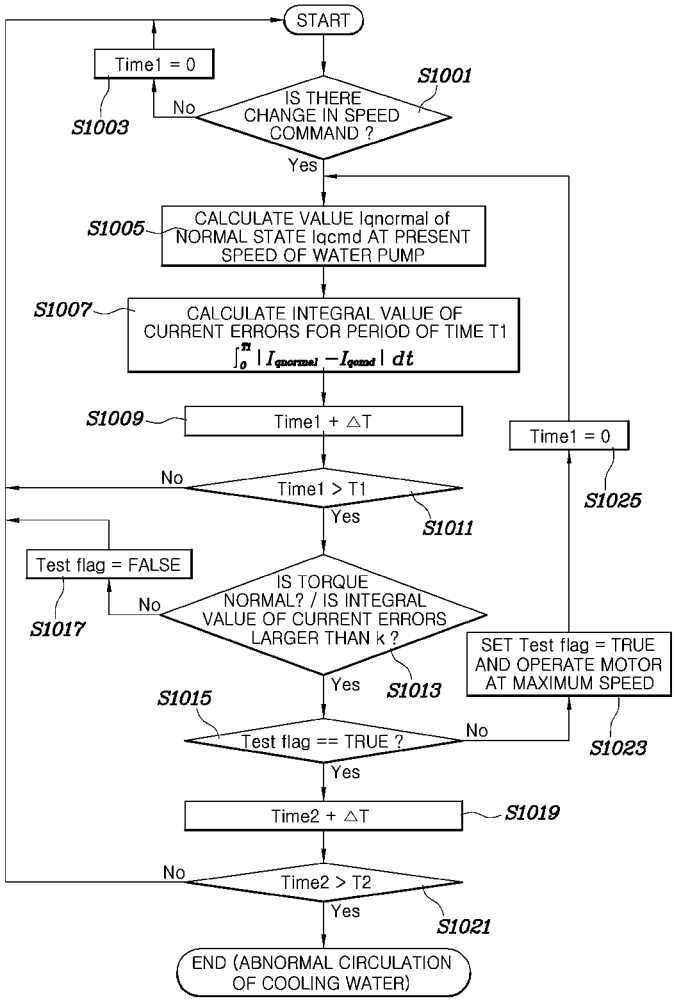

FIGS. 8 to 10 are exemplary flowcharts showing methods of determining a circulation state of cooling water according to other exemplary embodiments of the present invention. With reference to FIGS. 8 to 10, Steps S801 to S811, S901 to S909, and S1001 to S1011 correspond to Steps S501 to S511 in FIG. 5, Steps S601 to S609 in FIG. 6, and Steps S701 to S711 in FIG. 7, respectively, a description thereof is omitted.

With reference to FIG. 8, an absolute value of an error value between a calculated average value Iqcmd_means and a normal current command value Iqnormal that corresponds to a rotation speed may be compared with a preset error value β (Step S813). When the absolute value of the error value between the calculated average value Iqcmd_means and the normal current command value Iqnormal that corresponds to the rotation speed exceeds the preset error value β, the controller may be configured to determine whether a test mode has been activated (i.e. Test flag=TRUE) (Step S815). Further, when the absolute value of the error value between the calculated average value Iqcmd_means and the normal current command value Iqnormal that corresponds to the rotation speed is less than the preset error value β, mode switching to a test mode may not be performed (Step S817, Test flag=FALSE), and a predetermined constant speed command may be maintained.

In response to determining that the test mode is not activated in Step S815, the test mode may be set (Test flag=TRUE), and the driving motor of the cooling water-circulating pump may be rotated at a maximum rotation speed (Step S823). It may be possible to more accurately obtain an error value in current when the driving motor of the cooling water-circulating pump rotates at the maximum rotation speed. In other words, when the circulation of the cooling water is abnormal at the maximum rotation speed of the driving motor, an error value in the power of the driving motor may have a largest value. Additionally, the rotation speed of the driving motor may be set to a value obtained through experiment and at which the abnormal circulation of the cooling water may be the most easily determined. Besides the operation of the driving motor at the maximum rotation speed, the error value in current may also be determined using a repetitive alternate operation at a maximum rotation speed and a minimum rotation speed, a ramp acceleration/deceleration operation, a stepwise acceleration/deceleration operation.

The driving motor has the largest output error when an abnormality occurs in the circulation of the cooling water at the maximum rotational speed. Therefore, it is possible to accurately determine the error value of the current during driving so as to maintain the maximum rotation speed of the driving motor.

Also, because there is little flow load caused by the fluid when the circulation of the cooling water is abnormal, the current, torque, or output required at the time of acceleration appears to be very small in comparison with the steady state. Therefore, it is possible to accurately determine the error value of the current during the ramp acceleration or the step acceleration driving.

When the test mode is set and when the driving motor of the cooling water-circulating pump rotates at a constant maximum rotation speed, the average value Iqcmd_means of the current command values transmitted to the driving motor for a first period of time T1 may be calculated again (Step S805). The controller may be configured to determine whether the average value of the current command values for the first period of time T1 is calculated normally, after a predetermined period of time has passed since a first elapsed time time1 elapsed, by comparing the first elapsed time Time_1 and the first period of time T1 (Step S807, Step S809). When the first period of time T1 is less than the first elapsed time Time_1, the driving motor may be operated to adjust the rotation speed to be substantially constant (Step S801). When a substantially constant rotation speed is not maintained, the first elapsed time Time_1 may be reset (Step S803), and the driving motor may be operated to maintain a substantially constant rotation speed (Step S801).

Furthermore, a current command value Iqnormal that corresponds to the maximum rotation speed may be calculated (Step S811). The current command value Iqnormal that corresponds to a rotation speed may be obtained using a current command map based on the rotation speed. The current command value Iqnormal that corresponds to a rotation speed may be a substantially current command value in a normal state of the circulation of the cooling water at the rotation speed of the driving motor of the cooling water-circulating pump at a present time. The current command map may be a map in which normal current command values are mapped with rotation speeds obtained through experiments in which a cooling water-circulating pump operates normally or rotation speeds of data obtained through calculations.

An absolute value of an error value between the calculated average value Iqcmd_means and the normal current command value Iqnormal that corresponds to the rotation speed, and a preset error value β which may be compared (Step S813). When the absolute value of the error value between the calculated average value Iqcmd_means and the normal current command value Iqnormal that corresponds to the rotation speed exceeds the preset error value β, the controller may be configured to determine whether a test mode is activated (Test flag=TRUE) (Step S815). Since the test mode may be set in Step S823, the controller may be configured to determine whether a state where the absolute value of the error value between the calculated average value Iqcmd_means and the normal current command value Iqnormal that corresponds to the rotation speed exceeds the preset error value β is maintained for a preset second period of time T2. When the state where the absolute value of the error value between the calculated average value Iqcmd_means and the normal current command value Iqnormal that corresponds to the rotation speed exceeds the preset error value β is maintained for the second period of time T2, the controller may be configured to determine that the circulation state of the cooling water is abnormal.

The processing of FIG. 9 differs from the processing of FIG. 8 in that a standard deviation may be calculated instead of the average value of the current command value for the first period of time T1. Accordingly, whether to switch to the test mode may not be determined based on a determination on whether the absolute value of the error value between the calculated average value Iqcmd_means and the normal current command value Iqnormal that corresponds to a rotation speed exceeds the preset error value β, but may be determined based on a determination on whether the standard deviation Iqcmd_sd exceeds a preset deviation value ε.

When the calculated standard deviation exceeds the preset deviation value ε, the controller may be configured to determine that the test mode is activated (Test flag=TRUE) (Step S915). In addition, when the calculated standard deviation is equal to or less than the preset deviation value ε, switching to the test mode may not be performed (Step S917, Test flag=FALSE), and a constant speed command may be maintained (Step S901).

In response to determining that the test mode is not activated in Step S915, the test mode may be set (Test flag=TRUE), and the driving motor of the cooling water-circulating pump may be operated at a maximum rotation speed in Step S923. It may be possible to more accurately determine the error in current when the driving motor of the cooling water-circulating pump rotates at the maximum rotation speed. In other words, when an abnormal circulation of the cooling water occurs at the maximum rotation speed, the error value in the power of the driving motor may become a maximum. Additionally, the rotation speed of the driving motor may be set to a value obtained through experiment and at which the abnormal circulation of the cooling water may be the most easily detected. The error in current may also be obtained using a repetitive alternate operation at a maximum rotation speed and at a minimum rotation speed, a lamp acceleration/deceleration operation, or a stepwise acceleration/deceleration operation.

When the test mode is set and when the driving motor of the cooling water-circulating pump rotates at the maximum rotation speed, a standard deviation Iqcmd_sd of the current command values Iqcmd transmitted to the driving motor of the cooling water-circulating pump for the first period of time T1 may be calculated again in Step S905. Further, the controller may be configured to determine whether the standard deviation Iqcmd_sd of the current command values for the first period of time T1 is accurately calculated by comparing a first elapsed time Time_1 and the first period of time T1 after a predetermined period of time ΔT has elapsed since the first elapsed time Time_1 elapsed (Step S907, Step S909). When the preset first period of time T1 is less than the first elapsed time Time_1, the driving motor may be operated to adjust the rotation speed of the driving motor to be substantially constant (Step S901). Further, when the rotation speed of the driving motor is not constant, the first elapsed time may be reset (Step S903), and the driving motor may be operated to adjust the rotation speed of the driving motor to be substantially constant (Step S901).

Subsequently, the recalculated standard deviation may be compared with the preset deviation value ε (Step S911). When the calculated standard deviation exceeds the preset deviation value ε, the controller may be configured to determine whether the test mode is activated (e.g., set) (Test flag=TRUE) or not (Step S913). Since the test mode may be set in Step S921, when the state where the calculated deviation exceeds the preset deviation value ε may be maintained for a second period of time T2 (Step S917, Step S919), the controller may be configured to determine that the circulation state of the cooling water is abnormal.

With reference to FIG. 10, absolute values of errors between the current command values Iqcmd transmitted to the driving motor of the cooling water-circulating pump for the first period of time T1 and the normal state current command value Iqnormal may be integrated, and the value of the integral operation may be compared with a reference value k (Step S1013). When the value of the integral operation of the absolute values of the error values for the first period of time exceeds the reference value k, the controller may be configured to determine whether the test mode is activated (e.g., set) (Test flag=TRUE) (Step S1015). In addition, when the value of the integral operation of the absolute values of the errors for the first period of time T1 is equal to or less than the reference value k, switching to the test mode may not be performed (S1017, Test flag=FALSE), and a substantially constant speed command may be maintained again (Step S1001).

In response to determining that the test mode is not activated in Step S1015, the test mode may be set (Test flag=TRUE), and the driving motor of the cooling water-circulating pump may be operated at the maximum rotation speed (Step S1023). It may be possible to more accurately determine the error value in current when the driving motor of the cooling water-circulating pump operates at the maximum rotation speed. In other words, when the abnormal circulation of the cooling water occurs at the maximum rotation speed, the error value in the power of the driving motor may become a maximum. Additionally, the rotation speed of the driving motor may be a value obtained through experiment and at which the abnormal circulation of the cooling water may be the most easily determined. The error value in current may also be obtained using a repetitive alternate operation at a maximum rotation speed and a minimum rotation speed, a lamp acceleration/deceleration operation, or a stepwise acceleration/deceleration operation.

When the test mode is set and when the driving motor of the cooling water-circulating pump rotates at a constant maximum rotation speed, a normal state current command value Iqnormal at the maximum rotation speed may be calculated again (Step S1005). Further, absolute values of error values between current command values Iqcmd transmitted to the driving motor for the first period of time T1 and the normal state current command value Iqnormal may be integrated (Step S1007). The controller may be configured to determine whether the value of the integral operation for the first period of time T1 is accurately calculated by comparing the first elapsed time Time_1 and the preset first period of time T1 (Step S1009, Step S1011), after a predetermined period of time ΔT has elapsed since the first elapsed time Time_1 elapsed. When the preset first period of time T1 is less than the first elapsed time Time_1, the driving motor may be operated to adjust the rotation speed of the driving motor to be substantially constant again (Step S1001). In addition, when the rotation speed of the driving motor is not substantially constant, the first elapsed time may be reset (Step S803), and the driving motor may be maintained at a constant maximum rotation speed again (Step S801).

Furthermore, the absolute values of error values between the current command values Iqcmd transmitted to the driving motor of a cooling water-circulating pump for the first period of time T1 and the normal state current command value Iqnormal may be integrated, and the value of the integral operation may be compared with the reference value k (Step S1013). When the value of the integral operation of the absolute values of the error values for the first period of time T1 exceeds the reference value k, the controller may be configured to determine whether a test mode is set or activated (Test flag=TRUE) (Step S1015). Since the test mode may be set in Step S1023, when the state where the value of the integral operation exceeds the reference value k is maintained for the second period of time T2 (Step S1019, Step S1021), the controller may be configured to determine that the circulation state of the cooling water is abnormal.

When it is determined that the circulation state of the cooling water is not normal, a cooling system may be controlled to a safe mode. The cooling system may include the cooling water-circulating pump, valves for controlling the flow rate of the cooling water flow path, or a cooling fan for cooling the radiator.

When the cooling system is controlled to the safe mode, the driving motor of the cooling water-circulating pump may be controlled the maximum rotation speed. Otherwise, the driving motor may be operated to alternate at a maximum rotation speed and a minimum rotation speed.

Furthermore, when the cooling system is controlled to the safe mode, a valve for controlling flow rate of cooling water may be controlled to increase the flow rate to the radiator. By increasing the flow rate to the radiator, air bubbles generated in the cooling water may be removed.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method of determining a circulation state of cooling water, comprising:

operating, by a controller, a driving motor of a cooling water-circulating pump configured to circulate cooling water at a fixed current, a fixed torque, or a fixed power;

calculating, by the controller, an average rotation speed of the driving motor for a preset first period of time during the operation of the driving motor at the fixed current, the fixed torque, or the fixed power;

determining, by the controller, whether the circulation state of the cooling water is normal, based on an error value between the calculated average rotation speed and a preset reference rotation speed; and controlling a cooling system to a safe mode when it is determined that the circulation state of the cooling water is not normal, wherein the determination of the circulation state of the cooling water comprises enabling, by the controller, a test mode when the error value exceeds a preset error value, wherein the test mode comprises controlling the cooling water-circulating pump at a maximum rotation speed operation, a repetitive alternate operation at a maximum rotation speed and a minimum rotation speed, a ramp acceleration and deceleration operation, or a stepwise acceleration and deceleration operation, and determining whether the circulation state of the cooling water is normal.

2. The method according to claim 1, wherein the calculation of the average rotation speed comprises:

calculating, by the controller, a deviation in rotation speed of the driving motor for the preset first period of time.

3. The method according to claim 2, wherein the determination of the circulation state of the cooling water comprises:

determining, by the controller, whether the circulation state of the cooling water is normal by comparing a deviation in the calculated average rotation speed and a preset reference deviation.

4. The method according to claim 1, wherein the preset reference rotation speed is a rotation speed of the driving motor that corresponds to the fixed current, the fixed torque, or the fixed power.

5. A method of determining a circulation state of cooling water, comprising:

operating, by a controller, a driving motor disposed in a pump for circulating a cooling water to adjust a rotation speed of the driving motor to be constant;

determining, by the controller, whether the circulation state of the cooling water is normal using a power or a torque value of the driving motor obtained after the rotation speed of the driving motor is adjusted to be constant and a reference power or torque value during a normal state that corresponds to the constant rotation speed; and controlling a cooling system to a safe mode when it is determined that the circulation state of the cooling water is not normal, wherein the power or the torque value of the driving motor, and the reference power or torque value of the driving motor when the driving motor rotates at the constant rotation speed are each obtained using a current command value transmitted to the driving motor and a normal current command value during the normal state that corresponds to the constant rotation speed, and wherein the determination of the circulation state of the cooling water includes:

calculating, by the controller, an average value of the current command values transmitted to the driving motor for a first period of time after the rotation speed of the driving motor is adjusted to be constant; and enabling, by the controller, a test mode when an error value between the calculated average value and the normal current command value exceeds a preset error value;

wherein the test mode comprises controlling the cooling water-circulating pump at a predetermined rotation speed, and determining whether the circulation state of the cooling water is normal.

6. The method according to claim 5, wherein the determination of the circulation state of the cooling water includes:

normalizing, by the controller, by dividing the calculated average value by the normal current command value during the normal state that corresponds to the constant rotation speed.

7. The method according to claim 5, further comprising:

determining, by the controller, that the circulation state of the cooling water is abnormal when a state where the error value exceeds the preset error value is maintained for a second period of time.

8. The method according to claim 5, further comprising in the test mode:

determining, by the controller, that the circulation state of the cooling water is abnormal, when a state where the error value between the calculated average value and the normal current command value used when the driving motor rotates at a maximum rotation speed in the test mode exceeds the preset error value is maintained for a preset second period of time.

9. The method according to claim 5, wherein the preset error value varies according to the rotation speed of the driving motor.

10. The method according to claim 5, wherein the driving motor is maintained at a maximum rotation speed, when the test mode is enabled.

11. The method according to claim 5, wherein the driving motor is operated to alternate at a maximum rotation speed and a minimum rotation speed, when the test mode is enabled.

12. The method according to claim 5, wherein the driving motor is operated a ramp acceleration, when the test mode is enabled.

13. The method according to claim 5, wherein the driving motor is operated a stepwise acceleration, when the test mode is enabled.

14. The method according to claim 5, wherein the normal current command value that corresponds to the rotation speed is obtained using a preset current command map based on the rotation speed.

15. The method according to claim 5, wherein the determination of the circulation state of the cooling water includes:

calculating, by the controller, a deviation or a variation value in the current command values for the first period of time; and determining, by the controller, whether the circulation state of the cooling water is normal, based on a result of a comparison between the calculated deviation or variation value and the preset error value.

16. The method according to claim 15, further comprising:

determining, by the controller, that the circulation state of the cooling water is abnormal, when a state where the calculated deviation or variation value exceeds the preset error value is maintained for a second period of time.

17. The method according to claim 15, wherein a test mode is enabled, when the calculated deviation or variation value exceeds the preset error value.

18. The method according to claim 17, wherein the driving motor is maintained at a maximum rotation speed when the test mode is enabled.

19. The method according to claim 5, wherein the determination of the circulation state of the cooling water includes:

integrating, by the controller, an error between the normal current command value that corresponds to the constant rotation speed and the current command value transmitted to the driving motor; and determining, by the controller, whether the circulation state of the cooling water is normal, based on a result of a comparison between the value of the integral operation and the preset error value.

20. The method according to claim 19, further comprising:

normalizing, by the controller, by dividing the calculated average value by the normal current command value during the normal state that corresponds to the rotation speed.

21. The method according to claim 19, further comprising:

determining, by the controller, that the circulation state of the cooling water is abnormal, when a state where the value of the integral operation exceeds the preset error value is maintained for a second period of time.

22. The method according to claim 19, wherein a test mode is enabled when the value of the integral operation exceeds the preset error value.

23. The method according to claim 22, wherein the driving motor is maintained at a maximum rotation speed when the test mode is enabled.

* * * * *